US005974746A

United States Patent [19]

Mathias

[11] Patent Number: 5,974,746

[45] Date of Patent: Nov. 2, 1999

[54] DRYWALL TAPE WITH ATTACHED BEAD FOR APPLICATION TO NON RIGHT ANGLE CORNERS

[76] Inventor: Mark E. Mathias, 378 Archibald St, Kimberley, BC, Canada, V1A 1M9

[21] Appl. No.: 08/858,727

[22] Filed: May 19, 1997

[51] Int. Cl.[6] ..... F04B 2/00

[52] U.S. Cl. ..... 52/255; 52/287.1; 52/741.41

[58] Field of Search ..... 52/254, 255, 287.1, 52/417, 741.41

[56] References Cited

U.S. PATENT DOCUMENTS

| | | | |
|---|---|---|---|
| 2,314,523 | 3/1943 | Speer . | |
| 2,851,741 | 9/1958 | Stemple . | |
| 4,313,991 | 2/1982 | Lamb . | |
| 4,719,732 | 1/1988 | Bernard . | |
| 4,763,455 | 8/1988 | Schneller . | |
| 4,863,774 | 9/1989 | Tucker . | |
| 5,037,686 | 8/1991 | Conboy | 52/417 X |
| 5,131,198 | 7/1992 | Ritchie . | |
| 5,203,640 | 4/1993 | Pourtau et al. | 52/254 X |
| 5,313,755 | 5/1994 | Koenig . | |
| 5,368,907 | 11/1994 | Conboy | 52/417 X |
| 5,442,886 | 8/1995 | Iacobelli . | |

FOREIGN PATENT DOCUMENTS

| | | | |
|---|---|---|---|
| 661794 | 11/1951 | United Kingdom | 52/287.1 |

*Primary Examiner*—Christopher Kent
*Assistant Examiner*—Timothy B. Kang
*Attorney, Agent, or Firm*—David S. Thompson

[57] ABSTRACT

A drywall tape with an attached bead allows application of mud to adjacent drywall panels not oriented right angles. The bead is carried in a lengthwise orientation by the middle of the drywall tape on the side facing away from the drywall. The bead provides left and right rails that are typically 1/16 or 2/16 of an inch in height. The drywall tape is positioned in the corner between first and second drywall panels. The blade of the application tool is supported at one corner by a lip carried by one of the rails, and at the other corner by the surface of the first drywall panel. A guide tool is inserted into a groove between the rails of the bead at the upper end of the drywall tape, and is moved downwardly in tandem with an application tool. The application tool smooths mud about one side of the drywall tape carried on the first drywall panel. The guide tool carried by the groove prevents the application tool, or any mud pushed by the application tool, from contacting the second drywall panel.

6 Claims, 4 Drawing Sheets

DRYWALL TAPE WITH ATTACHED BEAD FOR APPLICATION TO NON RIGHT ANGLE CORNERS

BACKGROUND

In drywall construction, interior corners having an angle of greater than 90 degrees are more difficult to construct than ordinary 90 degree corners. Most such interior corners are presently constructed by using a compound to fill the joint between the two adjacent drywall panels forming the interior corner. Drywall tape is then bent into a V-shape and is adhered to the corner. Bending the tape in half, creating a crease lengthwise down the middle of the tape, tends to center the tape in the corner. A cement-like joint compound, typically referred to as "mud", is then applied over the tape, having a thickness tapering from about 0.10 inches at the center of the tape to as thin as possible several inches from the edges of the tape. Under the mud, the tape's outline should not be visible.

A version of this operation is easily performed by skilled workmen if the interior corner is 90 degrees. However, where the interior corner is greater than 90 degrees, the operation is more difficult, more time-consuming and the result may be less attractive. Moreover, many of the tools used in applying drywall tape to interior 90 degree corners are ineffective where the angle is other than 90 degrees.

A major problem with the current method of constructing non-right angle drywall corners is that the application tool, and mud pushed by the application tool, on a second-completed drywall panel tends to make contact with, and ruin, the finished mud on the adjacent first-completed drywall panel. Therefore, under the current system, where the angle between the adjacent drywall panels is greater than 90 degrees, application of mud to one drywall panel ruins the finish on an adjacent drywall panel.

For the foregoing reasons, there is a need for a new drywall tape and method of use that can rapidly produce a quality drywall interior corner of greater than 90 degrees.

SUMMARY

The present invention is directed to an apparatus that satisfies the above needs. A novel drywall tape is provided that allows rapid construction of high-quality non-right angle drywall corners.

A preferred version of the drywall tape of the invention, for use in taping adjacent drywall panels oriented at other than 90 degree angles, provides:

(A) An elongate drywall tape body having front and rear surfaces.

(B) A bead, carried by the front surface of the drywall tape body, where a first version of the bead may provide:

(1) A left rail, typically carrying a left lip directed outwardly, in the direction away from the right rail. The left lip may be used to support one comer of an application tool a small distance above the drywall, thereby allowing for the uniform and tapered application of mud to the corner.

(2) A right rail, typically carrying a right lip directed outwardly, in the direction away from the left rail. The right lip functions in a similar manner to the left lip. The left and right rails together define a groove between them. The groove allows for the movement of a guide tool in tandem with the application tool; the guide tool preventing disturbance to the mud on the side of the corner opposite the application tool.

(3) A base, carried by the front surface of the elongate drywall tape body, for supporting the left and right rails, where the base may provide:

(a) A left rail support, connecting the left rail to the base. And, (b) A right rail support, connecting the right rail to the base.

(C) The bead, carried by the front surface of the drywall tape body, may alternatively provide:

(1) A monorail, typically carrying a left lip and a right lip, each lip directed outwardly, in the direction away from the monorail. Each lip in turn may be used to support one corner of an application tool a small distance above the drywall, thereby allowing for the uniform and tapered application of mud to the comer.

(2) A shield, removably attached to the top surface of the monorail, suitable for preventing the application tool or mud carried by the application tool from disturbing the mud on the side of the shield opposite the application tool.

(3) Perforations, or similar breakable fastening means, to allow easy removal of the shield from the monorail after the mud has been applied to both sides of the drywall tape.

Using the first version of the bead, by simultaneously moving an application tool and a guide tool, a workman may then apply mud to a first drywall panel forming the corner. After application, the mud will taper from a thicker region closer to the corner to a very thin region past the edge of the drywall tape. During the application process, the blade of the application tool is supported at a first corner by the lip of one of the rails of the bead, a small distance above the drywall panel, and by a second corner touching the drywall surface. The guide tool is carried by the groove between the rails of the bead. The application tool and the guide tool are slid downwardly in tandem, pushing the mud below the application tool. The guide tool prevents the application tool, and mud pushed by the application tool, from touching the adjacent drywall panel which may be covered with wet mud.

It is therefore a primary advantage of the present invention to provide a novel drywall tape having an attached bead for use with an application tool that allows easier application of the drywall tape to non-right angle corners.

Another advantage of the present invention is to provide a novel drywall tape having an attached bead, where a lip carried by a rail of the bead supports one corner of the blade of an application tool a spaced distance above the surface of a drywall panel making a greater than 90 degree angle with an adjacent drywall panel.

Another advantage of the present invention is to provide a novel drywall tape having an attached bead, where the bead supports a guide tool in a groove between two rails, allowing the guide tool to be lowered in a straight line in tandem with the application tool, wherein the guide tool prevents the application tool from disturbing mud on the adjacent drywall panel.

Another advantage of the present invention is to provide a novel drywall tape having an attached bead, where the bead may alternately support a removable guide strip in a groove between two rails, wherein the removable guide strip prevents the application tool from disturbing mud on the adjacent drywall panel.

DRAWINGS

These and other features, aspects, and advantages of the present invention will become better understood with regard to the following description, appended claims, and accompanying drawings where:

DESCRIPTION

Figure 1:
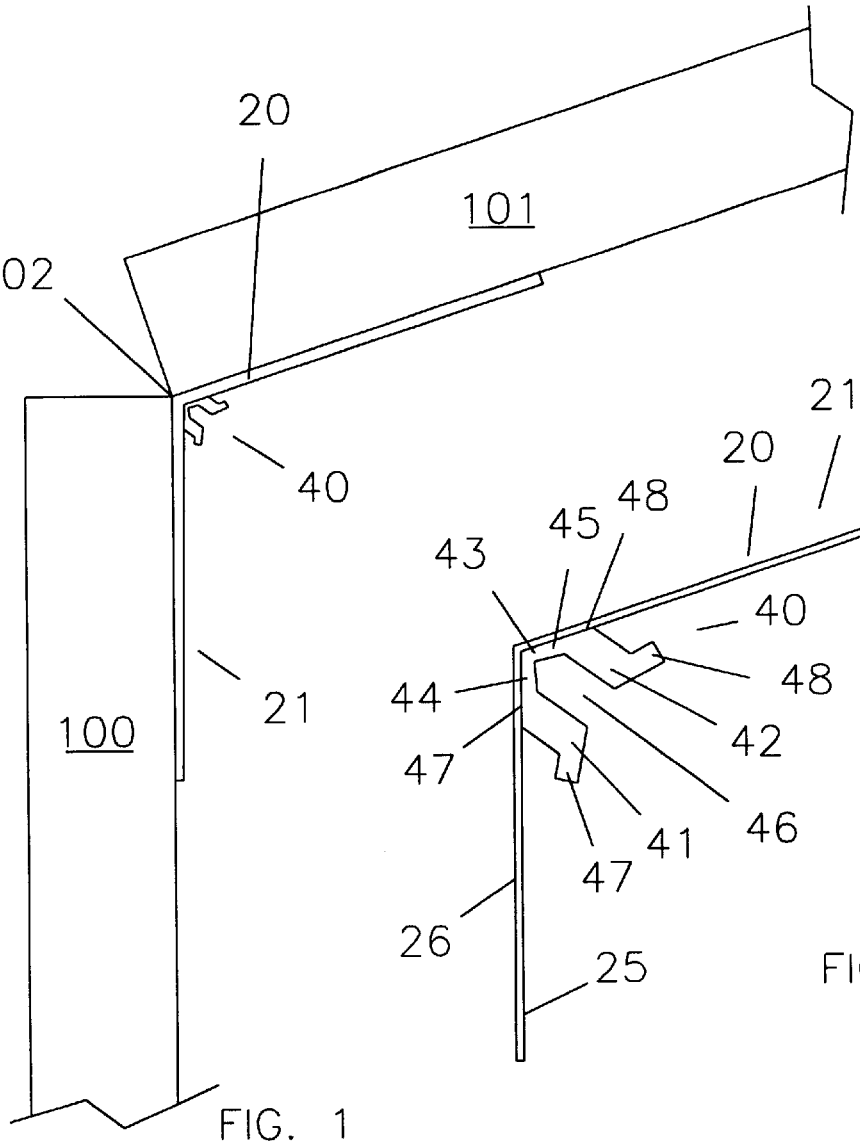
FIG. 1 is a top cross-sectional view of an obtuse-angled corner showing the structure of a version the drywall tape with an attached bead.
Figure 1A:
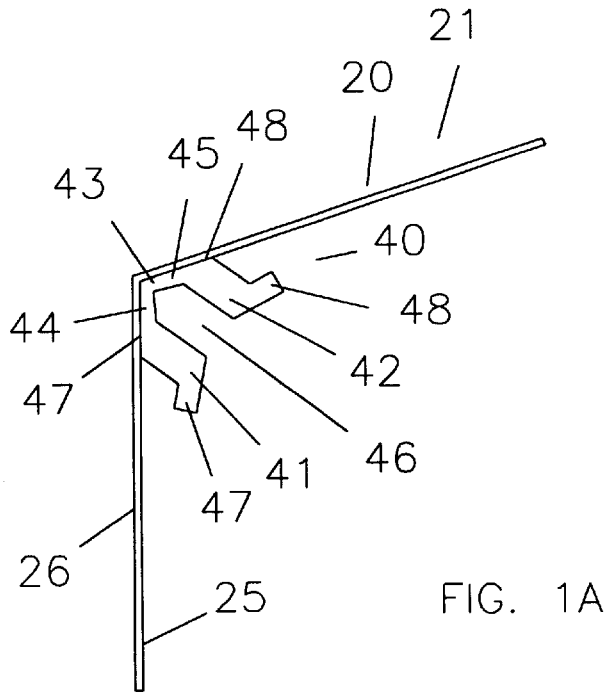
FIG. 1A is an enlarged view of a portion of FIG. 1.

Referring in particular to FIGS. 1 and 1A, an example of a drywall tape 20 having a bead 40 constructed in accordance with the principles of the invention is seen. The drywall tape is usable to finish the joint between left and right drywall panels 100, 101 forming a corner 102 having an angle of greater than 90 degrees. The drywall tape 20 provides a bead 40 having either left and right rails 41, 42 or a monorail 70 design. A rail may be used to support one corner of a blade of an application tool a small but precise distance above the surface of a drywall panel, thereby holding the application tool blade in a manner that results in a uniform tapered application of the mud. The groove 46 between the rails may be used to support a guide tool, thereby protecting mud freshly spread on the side of the guide tool opposite the application tool.

Drywall tape 20 provides an elongate body 21 which is similar in structure and configuration to known drywall tapes. The tape provides left and right edges 22, 23 and a imaginary centerline 24. A front surface 25 faces outwardly, while a rear surface 26 faces the drywall.

In a preferred embodiment, a bead 40 having left and right rails 41, 42 is carried by the elongate body 21 on the front surface 25 along the centerline 24. The left and right rails are separated by a groove 46, and are connected by a base 43.

Figure 2:
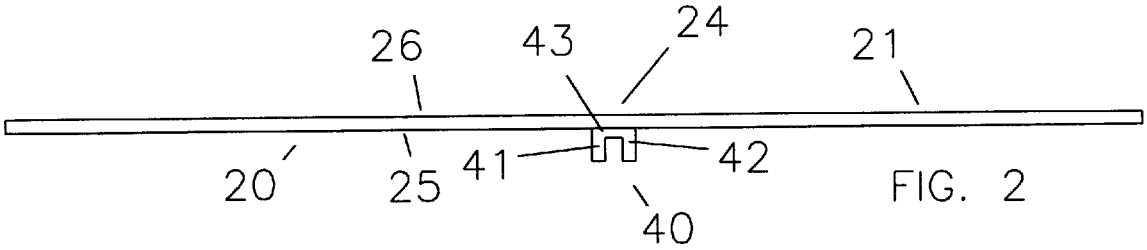
FIG. 2 is a top cross-sectional view of an economy version of the bead of the invention, having no lips on the rails.
Figure 2A:
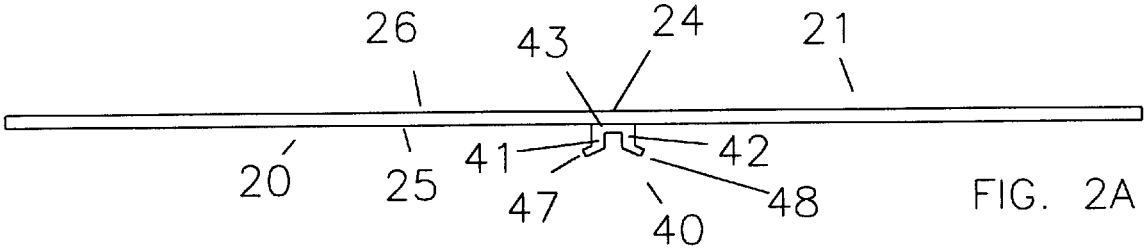
FIG. 2A is a top cross-sectional view of the version of the bead of FIG. 2, additionally having lips on the rails.

Referring to the versions of the invention seen in FIGS. 2 and 2A, it can be seen that the base 43 may support the left and right rails 41, 42 directly, without rail supports.

Figure 3:
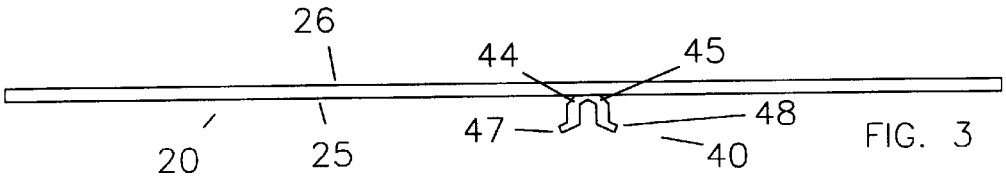
FIG. 3 is a top cross-sectional view of a version of the bead of the invention also seen in FIGS. 1, 1A, 5 and 7.

Referring to the version of the invention seen in FIG. 3, it can be seen that the base 43 may be formed by connected left and right rail supports 44, 45, which in turn support the rails 41, 42.

Figure 4:
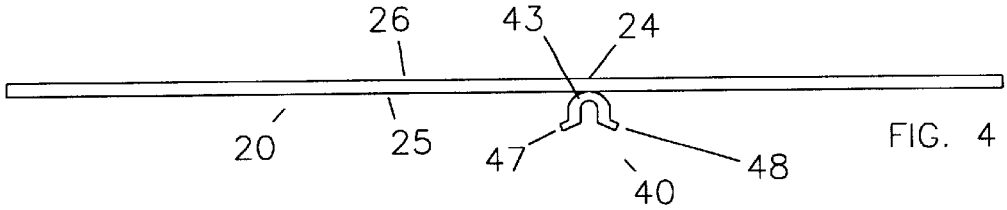
FIG. 4 is a top cross-sectional view of a further version of the bead of the invention.

Referring to the version of the invention seen in FIG. 4, it can be seen that the base and rail supports may be combined into one rounded portion.

Figure 5:
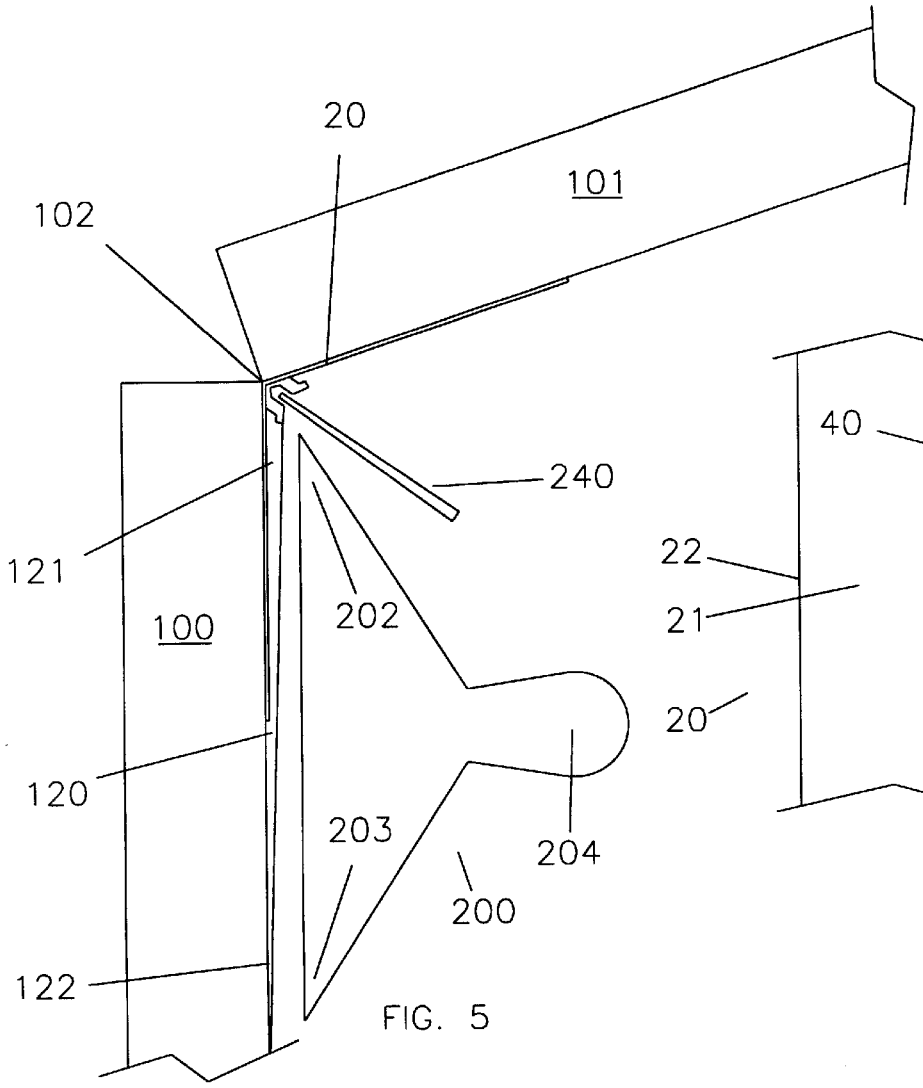
FIG. 5 is a top cross-sectional view of the drywall tape and bead of FIG. 1 showing the drywall mud, the application tool and the removable guide strip, with the application tool withdrawn slightly from the surface of the mud to more clearly show the structure of all elements.
Figure 6:
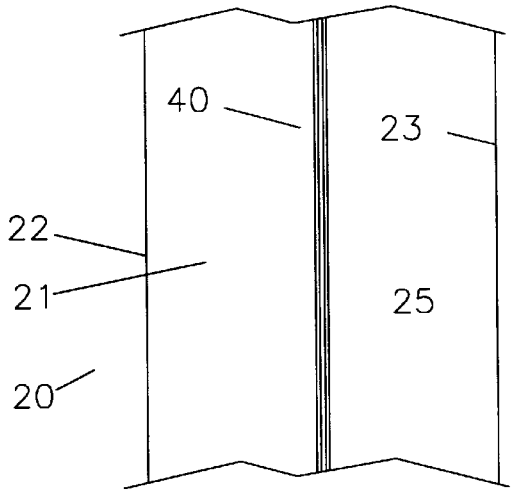
FIG. 6 is a front view of a section of drywall tape having a version of the attached bead of the invention seen in FIG. 2.
Figure 7:
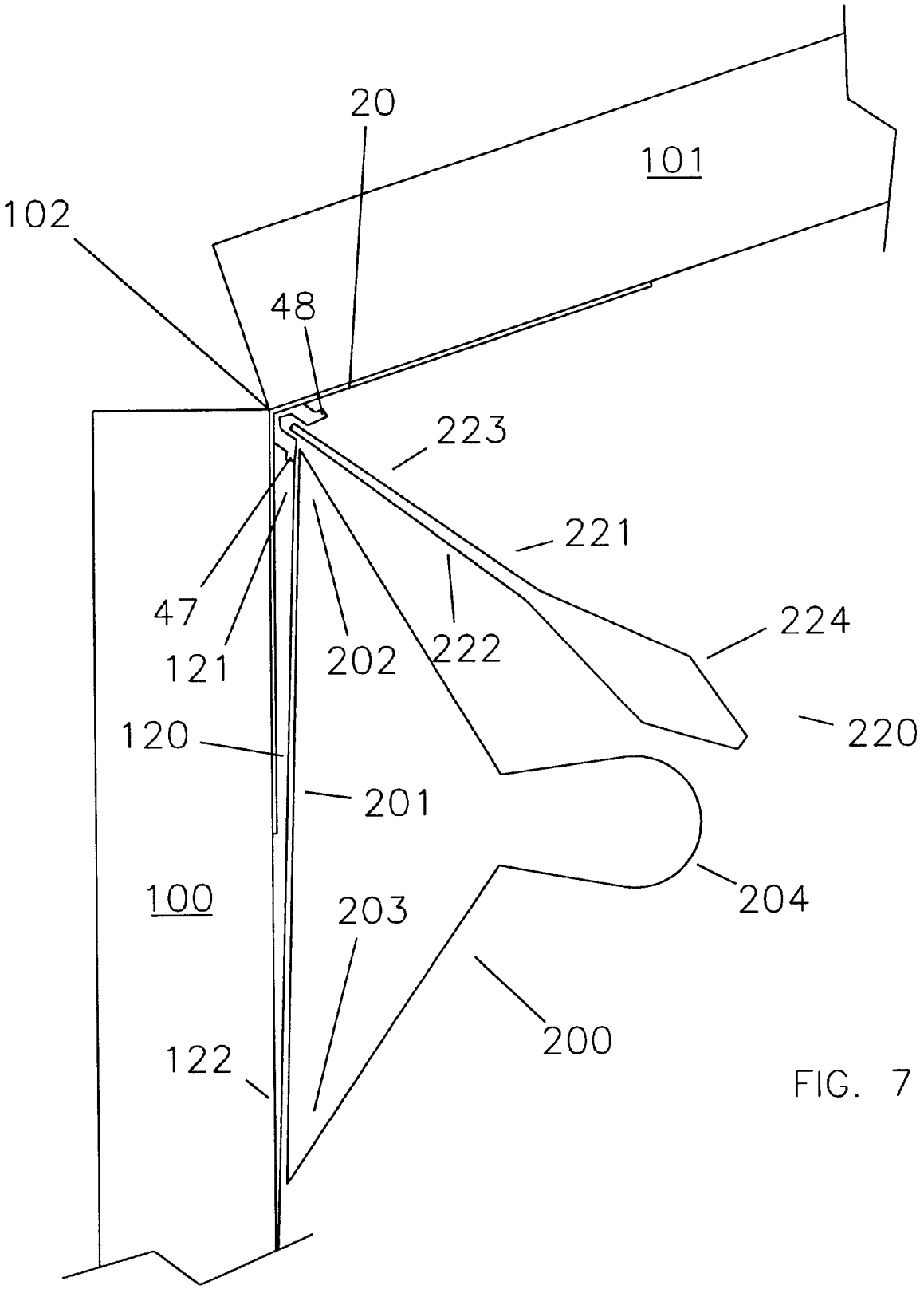
FIG. 7 is a top cross-sectional view of the drywall tape and bead of FIG. 1 showing the drywall mud in hatched cross-section, the application tool and the guide tool.

In most versions of the invention, left and right lips 47, 48 are carried by the left and right rails 41, 42. The function of the lips 47, 48 is to support one of the corners 202, 203 of the blade 201 of the application tool 200 nearest the corner 102 between the drywall panels. Therefore, as seen in FIG. 7, the right corner 202 of the blade 201 of the application tool 200 is supported by the left lip 47 as the application tool is used to push the mud downwardly, over the left side of the drywall tape. The left corner 203 rubs against the drywall panel, causing the mud to assume a tapered formation, as seen in FIGS. 5 and 7.

In the preferred embodiment of the invention, the rails 41, 42 are approximately one to two sixteenths of an inch in height. The distance between the rails, forming groove 46, is also typically one to two sixteenths of an inch. A variety of materials may be used to construct the bead, while still in keeping with the spirit and teachings of the invention. The rails 41, 42 and base 43 could be constructed of thin metal, plastic or rigid paper. The two essential features, which must be reflected in the construction, are first, that the bead must be sufficiently rigid so as to allow the guide tool to be passed through the groove 46 in a manner that allows the guide tool to protect a first dry wall panel from contact while mud is applied to a second drywall panel, and second, that the application tool to be supported by one rail a small distance above the drywall panel.

In a preferred version of the invention, the bead 40 is attached to the front surface 25 of the drywall tape 20 by means of adhesive.

The blade 221 of the guide tool 220 is incrementally narrower than the width of the groove 46 between the rails 41, 42, and is therefore sized to slide within the groove. An inside surface 222 of the blade 221 contacts the corner of the blade of the application tool 200, and mud pushed by the application tool, preventing either from contacting the drywall panel adjacent to the outside surface 223 of the blade. Typically, the width of the groove 46 is approximately one sixteenth of an inch. As seen in FIG. 7, the guide tool may be the same type of tool as the application tool, although the two tools are held at right angles to each other. The guide tool additionally provides a handle 224, which allows the tool to be conveniently moved downwardly.

As seen in FIG. 5, a removable guide strip 240 is a strip of plastic or similar material removably carried by the groove between the rails. The removable guide strip 240 performs the same function as the guide tool 220, i.e. both elements can be used to prevent the application tool, or mud pushed by the application tool, from contacting the side of the guide strip not being worked on. Thus, as seen in FIG. 5, the removable guide strip 240 prevents the application tool 200 and mud pushed by that tool, located on the left of the plastic guide, from contacting the right edge of the drywall tape and the right drywall panel 101.

Figures 8, 9:
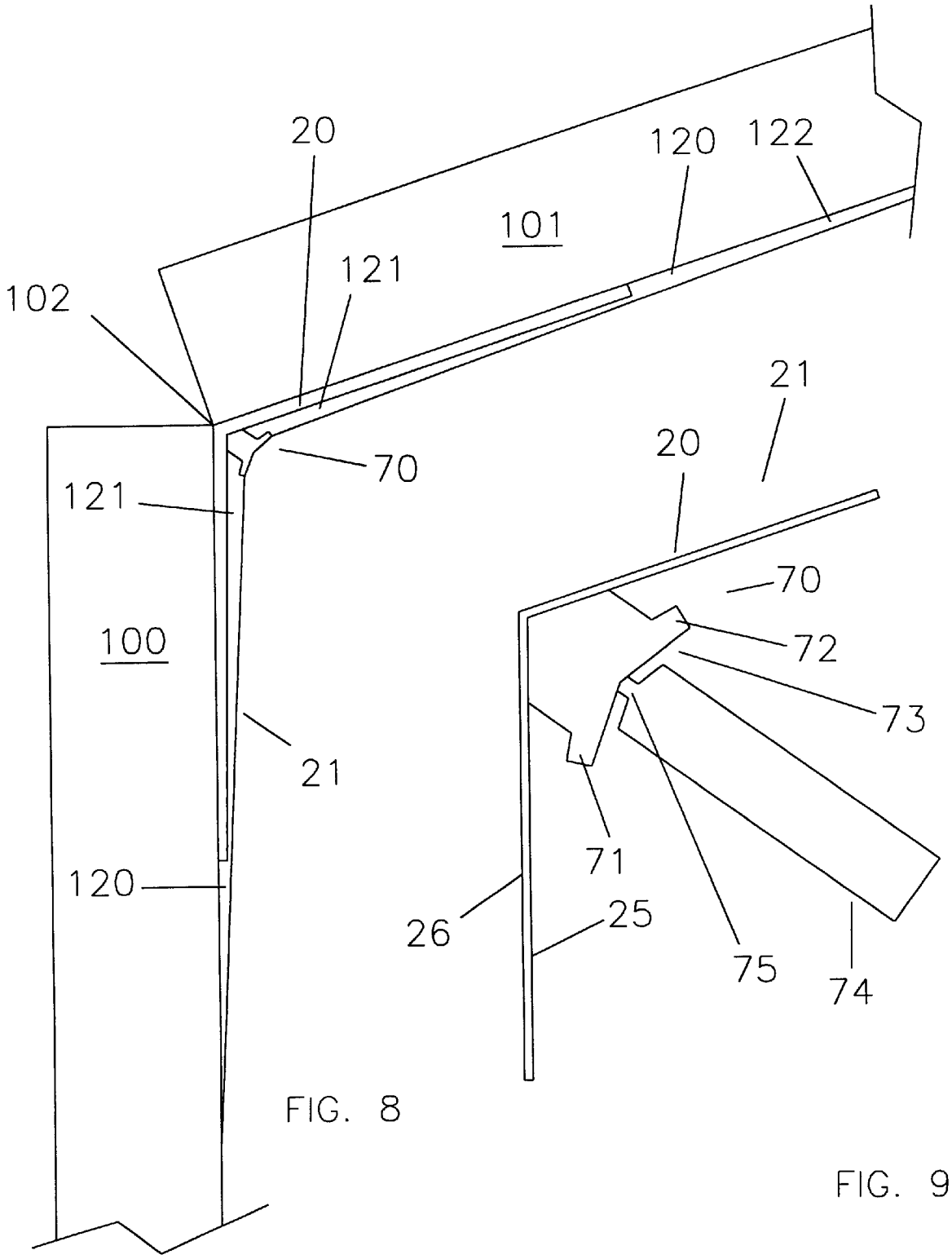
FIG. 8 is a top cross-sectional view of a second version of the drywall tape with bead, where the bead is formed of a monorail design, showing mud having been applied and the shield removed.
FIG. 9 is an enlarged view of the version of the invention of FIG. 8, with the shield still attached.

A second species of the invention, seen in FIGS. 8 and 9, provides a bead constructed of a single monorail 70 rather than dual rails 41, 42. The monorail provides oppositely directed left and right lips 71, 72. In the preferred version, the monorail is approximately one-sixteenth of an inch in height and width, and the length of the drywall tape which carries it. The monorail provides a top surface 73 which carries a shield 74. The shield may extend approximately an inch from the surface of the drywall tape, and will extend the entire length of the tape. The width of the shield may be approximately one-sixteenth of an inch. When the tape is positioned in the corner formed by two adjacent drywall panels not forming a 90 degree angle, the shield will bisect the angle between the two panels. The monorail 70, lips 71, 72 and shield 74 are typically made of plastic, but may be made of metal or other material, as desired. The shield performs the same functionality of the guide tool 220 of the first version of the invention, i.e. to prevent the disturbance of the mud applied to a first side of the drywall tape while applying mud to the second side of the drywall tape.

After application of the mud and following a suitable drying period, the shield 74 may be removed from the top surface 73 of the monorail by breakable fastening means such as perforations 75. Once removed, the shield may be discarded. The shield is shown in FIG. 9, but has been removed following application of the mud in FIG. 8.

To use the first version of the drywall tape with attached bead of the invention, a workman positions a segment of the drywall tape from the floor to the ceiling between two adjacent drywall sections typically having an angle between them of greater than 90 degrees, but less than 180 degrees. The drywall tape may be folded slightly along the centerline 24 if desired.

Mud 120 is then applied to the drywall tape, one side at a time. As seen in FIGS. 5 and 7, the mud is applied to the left side of the tape by means of an application tool 200 having a right corner 202 of its blade 201 sliding on the left lip 47 of the left rail 41 of the bead. Where the bead has no lip, the corner of the blade rides directly on the rail of the bead. The left corner 203 of the blade of the application tool is slid along the drywall parallel to the left of edge 22 of the drywall tape 20. The guide tool 220 is inserted into the groove 46 between the rails 41, 42.

Together, the application tool 200 and the guide tool 220 are slid downwardly by use of their handles 204, 224. The application tool pushes a mass of mud, forcing the mud 120 to assume the tapered configuration seen in FIGS. 5 and 7, where a thicker are of mud 121 is adjacent to the bead 40, and a thinner area of mud 122 is more distant from the bead. The guide tool prevents the application tool or the mass of mud from contacting the right side of the drywall tape or the right drywall panel.

The process is then repeated on the right side.

The process is similar where the removable guide strip 240 is used in place of the guide tool 220. However, where the removable guide strip 240 is used, the strip is put into position prior to smoothing the mud. The strip 240 would extend from the top of the drywall panels (at the ceiling) to the bottom of the drywall panels (at the floor). The mud is then pushed by application tool, thereby smoothing it in the manner seen in FIG. 5. The removable guide strip prevents contact with the opposite drywall panel. After application of the mud is complete on both sides of the removable guide strip 240, the strip is removed.

The previously described versions of the present invention have many advantages, a primary advantage of providing a novel drywall tape having an attached bead for use with an application tool that allows easier application of the drywall tape to non-right angle corners.

Another advantage of the present invention is to provide a novel drywall tape having an attached bead, where a lip carried by a rail of the bead supports one corner of the blade of an application tool a spaced distance above the surface of a drywall panel making a greater than 90 degree angle with an adjacent drywall panel.

Another advantage of the present invention is to provide a novel drywall tape having an attached bead, where the bead supports a guide tool in a groove between two rails, allowing the guide tool to be lowered in a straight line in tandem with the application tool, wherein the guide tool prevents the application tool from disturbing mud on the adjacent drywall panel.

Another advantage of the present invention is to provide a novel drywall tape having an attached bead, where the bead may alternatively support a removable guide strip in a groove between two rails, wherein the removable guide strip prevents the application tool from disturbing mud on the adjacent drywall panel.

Although the present invention has been described in considerable detail and with reference to certain preferred versions, other versions are possible. For example, the exact dimensions of the bead are not essential, and a workman knowledgeable in the drywall trade may envision slight structural variations on the disclosed invention that would be functionally equivalent. Additionally, while the above text emphasizes the advantages of the invention in finishing corners formed by drywall panels oriented at an angle between 90 and 180 degrees, it is clear that the same structures and methods would be applicable where the panels were oriented at angles of less than 90 degrees. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for aiding in the finishing process of the joint between adjacent drywall panels by application of mud pushed by an application tool, the apparatus comprising:

(A) drywall tape, having an elongate body having front and rear surfaces;

(B) a bead, carried by a center line defined on the front surface of the drywall tape, the bead defining an elongate groove; and (C) guide tool means, carried by and traveling within the elongate groove, for preventing passage of mud across the center line during the finishing process, whereby the finishing process on a first side of the center line does not disturb the finishing process on a second side of the center line.

2. The drywall tape of claim 1, wherein the bead additionally comprises:

(A) a left rail; and (B) a right rail.

3. A drywall tape, comprising:

(A) an elongate body having front and rear surfaces;

(B) a bead, carried by the front surface, comprising:

(a) a left rail;

(b) a right rail; and (c) base means, carried by the front surface of the elongate body, for supporting the left and right rails; and (C) a removable guide strip, carried between the left and right rails.

4. The drywall tape of claim 3, in which the base means comprises:

(A) a left rail support; and (B) a right rail support.

5. An apparatus for aiding in the finishing process of the joint between adjacent drywall panels, comprising:

(A) an elongate body having front and rear surfaces;

(B) a bead, carried by the front surface, defining an elongate groove oriented parallel to the elongate body; and (C) a guide tool, carried by and traveling within the elongate groove, for preventing passage of mud across the center line during the finishing process, whereby the finishing process on a first side of the center line does not disturb the finishing process on a second side of the center line.

6. A method of applying drywall mud to drywall panels forming a corner of greater than 90 degrees, comprising:

(A) supporting a segment of drywall tape adjacent to the corner; and (B) applying the mud to the drywall tape by sliding an application tool supported at one corner by a lip on a first rail of a bead carried by the drywall tape while simultaneously moving a guide tool through a groove between the first rail and a second rail of the bead.

* * * * *